US009062588B2

(12) United States Patent
Iwata et al.

(10) Patent No.: US 9,062,588 B2
(45) Date of Patent: Jun. 23, 2015

(54) EXHAUST SYSTEM OF SADDLE-RIDE TYPE VEHICLE

(71) Applicant: Honda Motor Co., Ltd., Tokyo (JP)

(72) Inventors: Masayuki Iwata, Wako (JP); Yuuhei Mukai, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 14/036,082

(22) Filed: Sep. 25, 2013

(65) Prior Publication Data

US 2014/0090920 A1 Apr. 3, 2014

(30) Foreign Application Priority Data

Sep. 28, 2012 (JP) ..... 2012-217666

(51) Int. Cl.

| | |
|---|---|
| ***B62D 61/02*** | (2006.01) |
| ***B62K 11/00*** | (2006.01) |
| ***F01N 13/08*** | (2010.01) |
| ***F01N 13/00*** | (2010.01) |
| ***F01N 13/18*** | (2010.01) |
| ***F01N 13/20*** | (2010.01) |
| ***F01N 1/08*** | (2006.01) |

(52) U.S. Cl.

CPC ..... *F01N 13/002* (2013.01); *F01N 13/1805* (2013.01); *F01N 13/20* (2013.01); *F01N 1/083* (2013.01); *F01N 1/084* (2013.01)

(58) Field of Classification Search

CPC ..... B62D 61/02; B62K 11/00; B62K 11/02; B60K 13/04; F01N 13/08

USPC ..... 180/219, 309, 908, 210, 225; 181/227, 181/228

See application file for complete search history.

(56) References Cited

U.S. PATENT DOCUMENTS 6,431,311 B1 * 8/2002 Brown et al. ..... 181/282
7,882,700 B2 * 2/2011 Yamakura et al. ..... 60/323

FOREIGN PATENT DOCUMENTS

JP 2009-108824 A 5/2009

* cited by examiner

*Primary Examiner* — Hau Phan
*Assistant Examiner* — Bryan Evans
(74) *Attorney, Agent, or Firm* — Birch, Stewart, Kolasch & Birch, LLP

(57) ABSTRACT

A saddle-ride type vehicle that allows easy axle adjustment even if the exhaust system has such a structure wherein a muffler is close to an axle of a rear wheel. The exhaust system includes a tubular muffler connected to an exhaust pipe for discharging the exhaust of an engine. In the exhaust system, the muffler is disposed laterally to a rear wheel rotatably supported by swingarms via an axle. An end cap covering a muffler rear end portion of the muffler is detachably and attachably provided on the muffler rear end portion with the end cap being disposed on a vehicle outer side of the axle at such a position that the axle is invisible in a side view of the vehicle.

17 Claims, 11 Drawing Sheets

EXHAUST SYSTEM OF SADDLE-RIDE TYPE VEHICLE

CROSS-REFERENCE TO RELATED APPLICATIONS

The present application claims priority under 35 USC 119 to Japanese Patent Application No. 2012-217666 filed Sep. 28, 2012 the entire contents of which are hereby incorporated by reference.

BACKGROUND OF THE INVENTION

1. Field of the Invention

The present invention relates to an exhaust system of a saddle-ride type vehicle. More particularly, to an exhaust system of a saddle-ride type vehicle in which a muffler is disposed lateral to an axle of a rear wheel.

2. Description of Background Art

Saddle-ride type vehicles, such as motorcycles, are known wherein an exhaust pipe for discharging combustion exhaust gas extends toward the rear of the vehicle with a muffler connected to a rear portion of the exhaust pipe being disposed lateral to a rear wheel. See, for example, Japanese Patent Application Publication No. 2009-108824.

Moreover, in a motorcycle on which a rider can ride in a relatively relaxed posture and which is thereby suitable for a long-hours of riding, the riding position is set relatively low and vehicle-mounted cases are provided on left and right sides of the rear wheels in a vehicle rear portion. In this type of motorcycle, the muffler disposed lateral to the rear wheel is set to be disposed at a low position to avoid interference with the vehicle-mounted cases.

In a motorcycle, an axle adjustment, wherein the tension of a rear wheel drive chain is adjusted, is performed as part of the vehicle maintenance. However, in a motorcycle wherein the riding position is set relatively low and the vehicle-mounted cases are provided on the left and right sides of the rear wheel, the muffler is disposed close to the axle of the rear wheel. Accordingly, this type of motorcycle has a problem wherein it is necessary to removal the muffler when an axle adjustment is required. Thus, the workability of maintenance is deteriorated by the muffler.

SUMMARY AND OBJECTS OF THE INVENTION

The present invention has been made in view of the circumstances described above. It is an object of an embodiment of the present invention to provide an exhaust system of a saddle-ride type vehicle that allows easy axle adjustment even if the exhaust system has such a structure that a muffler is close to an axle of a rear wheel.

For the purpose of solving the above-mentioned problems, an embodiment of the present invention provides an exhaust system of a saddle-ride type vehicle that includes a tubular muffler connected to an exhaust pipe for discharging exhaust of an engine with the muffler being disposed laterally to a rear wheel rotatably supported by a swingarm via an axle. In the exhaust system, an end cap configured to cover a muffler rear end portion of the muffler is detachably and attachably provided on the muffler rear end portion with the end cap being disposed on a vehicle outer side of the axle at such a position that the axle is invisible in a side view of the vehicle.

According to an embodiment of the present invention, the end cap is attached to a boss portion provided in the muffler rear end portion with a fastening member. The boss portion is provided at two positions on an upper side and a lower side of a vertical direction of the vehicle which are symmetric to each other about a muffler center axis.

According to an embodiment of the present invention, an end cap stay configured to fix the end cap is provided in the muffler rear end portion. The end cap stay includes a cap attachment surface portion formed to have an arc shape surrounding a muffler center axis of the muffler and a substantially inverted-C-shape opened on the axle side in a rear view of the vehicle with a plurality of leg portions extending from the cap attachment surface portion toward a closing wall of the muffler rear end portion. The leg portions are disposed on the vehicle outer side of the muffler center axis.

According to an embodiment of the present invention, the cap attachment surface portion is disposed in such a way that a cap attachment surface portion center point of a space into which a tail pipe for discharging the exhaust from muffler is inserted is offset from the muffler center axis to the vehicle outer side.

According to an embodiment of the present invention, the leg portions of the end cap stay are welded to the closing wall.

According to an embodiment of the present invention, a tail pipe center axis of the tail pipe is offset from the muffler center axis to the vehicle outer side. In addition, the cap attachment surface portion center point is arranged on the tail pipe center axis.

According to an embodiment of the present invention, an insertion portion provided at a front end of the end cap is inserted to come into contact with an end cap inserted portion of the muffler rear end portion.

According to an embodiment of the present invention, an end cap center axis of the end cap and the muffler center axis of the muffler are coaxially arranged with a tail pipe hole of the end cap through which the tail pipe is inserted being offset from the end cap center axis.

According to an embodiment of the present invention, the axle is located on the inner side of the end cap of the muffler and the axle is invisible in a side view of the vehicle. Accordingly, the appearance is improved. Moreover, since the end cap located on the outer side of axle is detachable and attachable, the end cap can be removed when it is necessary to perform maintenance such as an axle position adjustment to secure a work space. Thus, the workability can be thereby improved.

According to an embodiment of the present invention, the boss portion provided in the muffler rear end portion is provided at two positions on the upper side and the lower side of the vertical direction of the vehicle that are symmetric to each other about the muffler center axis. Accordingly, when the end cap is removed, a space in a muffler left-right direction can be secured around the muffler rear end portion and interference between the boss portions and tools for axle position adjustment can be avoided during maintenance work and the like.

According to an embodiment of the present invention, the end cap stay includes the cap attachment surface portion opened on the axle side with the leg portions extending from the cap attachment surface portion being disposed on the vehicle outer side of the muffler center axis. Accordingly, interference between the end cap stay and the tools for axle adjustment can be avoided when the end cap is removed.

According to an embodiment of the present invention, the cap attachment surface portion center point of the cap attachment surface portion is arranged to be offset to the vehicle outer side of the muffler center axis. Accordingly, a larger space on the axle side of the muffler rear end portion can be secured when the end cap is removed. Thus, interference between the end cap stay and the tools needed for an axle position adjustment can be effectively avoided during maintenance works and the like.

According to an embodiment of the present invention, the end cap stay is welded. Accordingly, members such as fastening members for attaching the end cap stay to the muffler are unnecessary and the number of parts can be reduced.

According to an embodiment of the present invention, the tail pipe is offset from the muffler center axis to the vehicle outer side. Accordingly, interference between the tail pipe and the tools for the axle position adjustment can be avoided during maintenance work and the like. Moreover, since the center of the muffler can be arranged closer to the vehicle, a sufficient bank angle of the vehicle can be secured.

According to an embodiment of the present invention, the insertion portion at the front end of the end cap is inserted to come into contact with the end cap inserted portion of the muffler rear end portion. Accordingly, the alignment of the end cap center axis and the muffler center axis is facilitated in the mounting and assembly of the end cap and the assemblability of the end cap is thereby improved. In addition, the number of fastening members for fixing the end cap can be reduced.

According to an embodiment of the present invention, the end cap center axis and the muffler center axis are aligned with each other and the tail pipe and the tail pipe hole are offset from the end cap center axis. Accordingly, the tail pipe is disposed on the vehicle outer side and the work space for axle adjustment can be secured. In addition, since the end cap is disposed coaxially with the muffler center axis, the muffler body portion and the end cap looks uniform. Thus, the appearance is improved.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
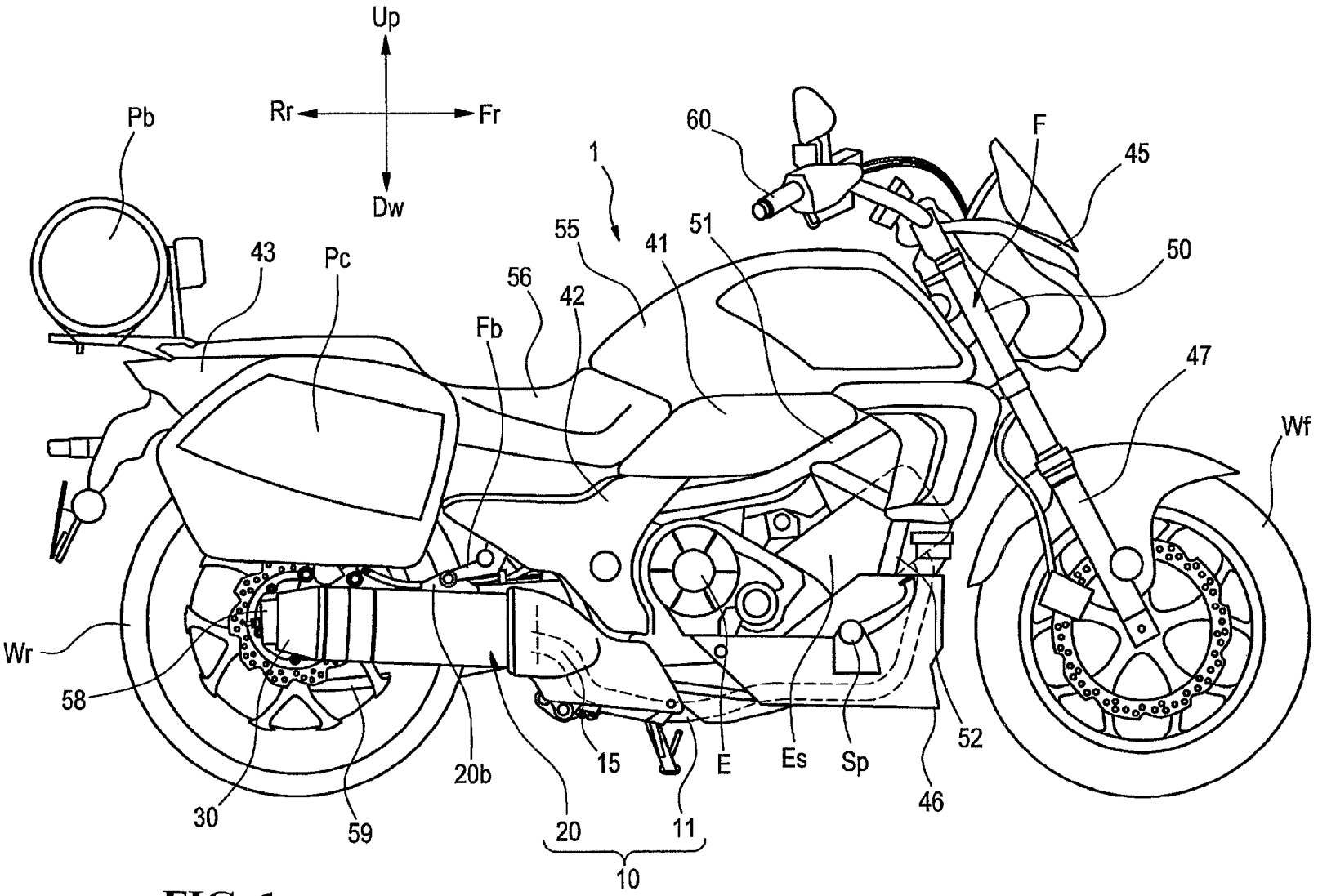
FIG. 1 is a right-side view of a saddle-ride type vehicle including an exhaust system of the present invention.

An embodiment of the present invention is described below.

A motorcycle which is a saddle-ride type vehicle being an embodiment of the present invention is described in detail with reference to FIGS. 1 to 11.

Note that the drawings are to be viewed in a direction in which reference numerals can be read correctly. Moreover, directions with respect to the operating direction of the motorcycle are shown in the drawings, in which Fr denotes a forward direction, Rr denotes a rearward direction, Up denotes an upward direction, Dw denotes a downward direction, L denotes a leftward direction, and R denotes a rightward direction.

Figure 2:
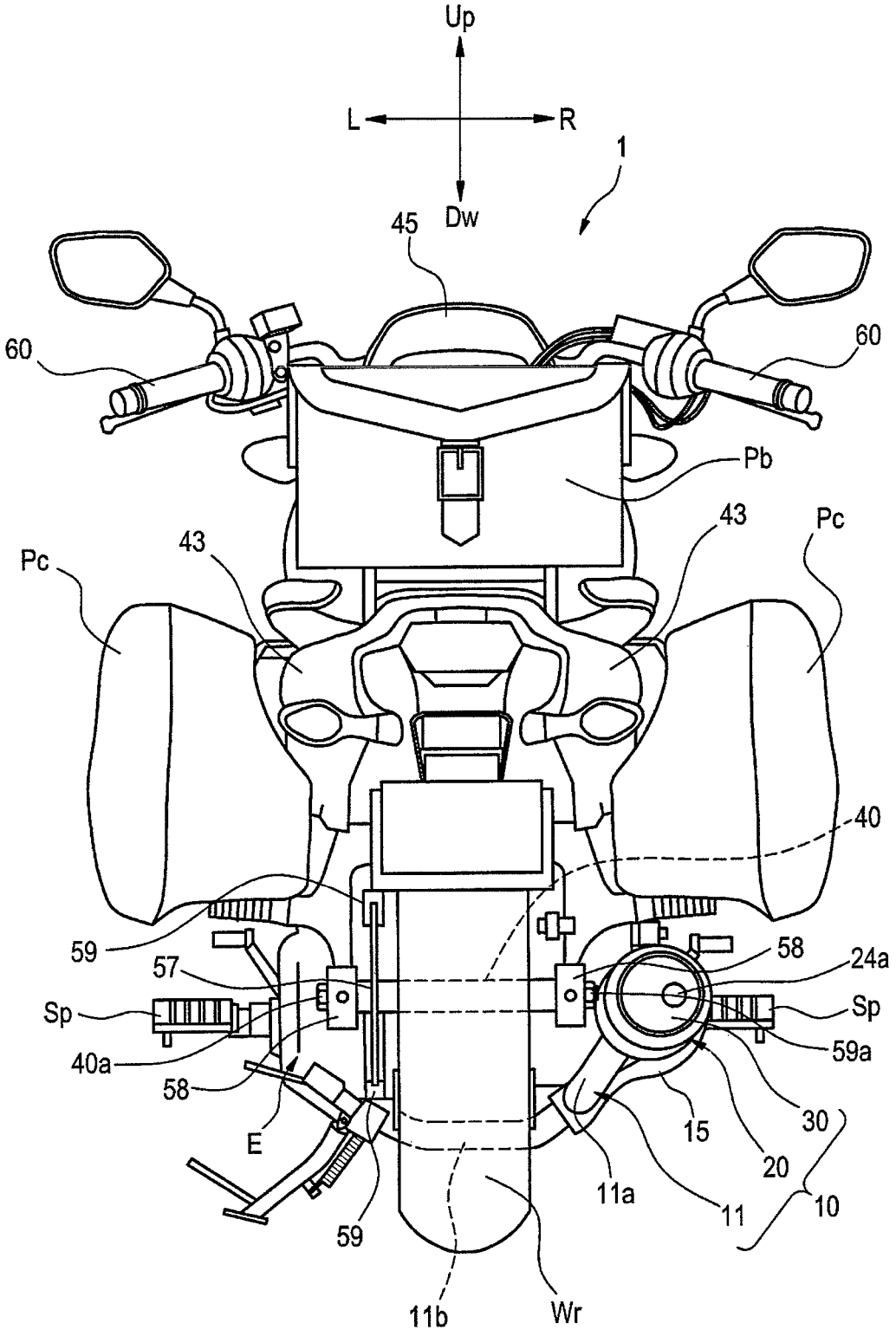
FIG. 2 is a back view of the saddle-ride type vehicle shown in FIG. 1 as viewed from the back.

FIG. 1 shows a side view of a motorcycle 1 of the embodiment as viewed from the right side and FIG. 2 shows a back view of the motorcycle 1 as viewed from the back side.

The motorcycle 1 has a structure in which constituent parts are attached to a vehicle body frame F serving as a framework. More specifically, the vehicle body frame F is provided with a head pipe 50 in a vehicle front end portion and includes a pair of main frames 51, 51 that extend to, for example, left and right from the head pipe 50 and that extend rearward while inclining downward toward the rear. The vehicle body frame F is also provided with down tubes 52, 52 extending toward the bottom and rear of the vehicle body below the main frames 51, 51 and seat rails (not illustrated) extending obliquely upwardly toward the rear of the vehicle from rear end portions of the main frames 51, 51. An engine E is held between the main frames 51, 51 and the down tubes 52, 52.

A front fork 47 supporting a front wheel Wf is steerably supported by the head pipe 50 and a steering handlebar 60 is coupled to an upper portion of the front fork 47. A rear wheel Wr is rotatably held by a swingarm 58 that is swingably attached to the vehicle body frame F behind the engine and which is vertically swingably supported by a rear fork (not illustrated). A drive force of the engine E is transmitted to a sprocket 57 (see FIG. 2) via a chain 59 and the sprocket 57 is thereby driven.

An exterior of the motorcycle 1 in the embodiment is covered with a vehicle body cover as appropriate. More specifically, the exterior of the motorcycle 1 is covered as appropriate with a front cover 45 covering a portion at a vehicle front end side of the head pipe 50, a front side cover 41 covering a lower side of a fuel tank 55, a side cover 42 covering a portion behind the engine, a bottom cover 46 covering a lower side of the engine, and a rear side cover 43 covering a portion below a rider seat 56.

The fuel tank 55 is held above the main frames 51, 51. The rider seat 56 behind the fuel tank 55, pannier cases Pc, Pc disposed on left and right sides of an upper portion of the rear wheel Wr, a back case Pb at a rearmost end of the vehicle, and the like are provided on the seat rails via brackets as needed. As described above, the motorcycle 1 of the embodiment is provided with many storage cases and is a type of vehicle in which foot rests Sp for placing the foots during riding are disposed closer to the front of the vehicle and the rider rides in a relatively relaxed posture and which is thereby suitable for touring and the like.

An exhaust system 10 in the embodiment includes an exhaust pipe 11 extending toward the rear of the vehicle from the engine E and a muffler 20 connected to a rear end of the exhaust pipe 11. As shown in FIGS. 1 and 2, the muffler 20 extends toward the rear of the vehicle, below the pannier case Pc on the right side of the rear wheel Wr, in parallel to the swingarm 58. Moreover, an end cap 30 whose diameter becomes smaller toward the vehicle rear end is mounted at a rearmost end of the muffler 20.

The exhaust pipe 11 of the exhaust system 10 is connected to an exhaust port of a cylinder portion Es in a front portion of the engine E and extends toward the rear of the vehicle, on the lower side of the engine E and on the vehicle left side for example. This portion of the exhaust pipe 11 is connected to the muffler 20 via: a rightward-curving portion 11*b* (see FIG. 2) curving toward the right side of the vehicle, near a point where the exhaust pipe 11 passes beyond a space under the engine E and a rising portion 11*c* (see FIGS. 2 and 3) rising while curving upward and rearward.

Figure 3:
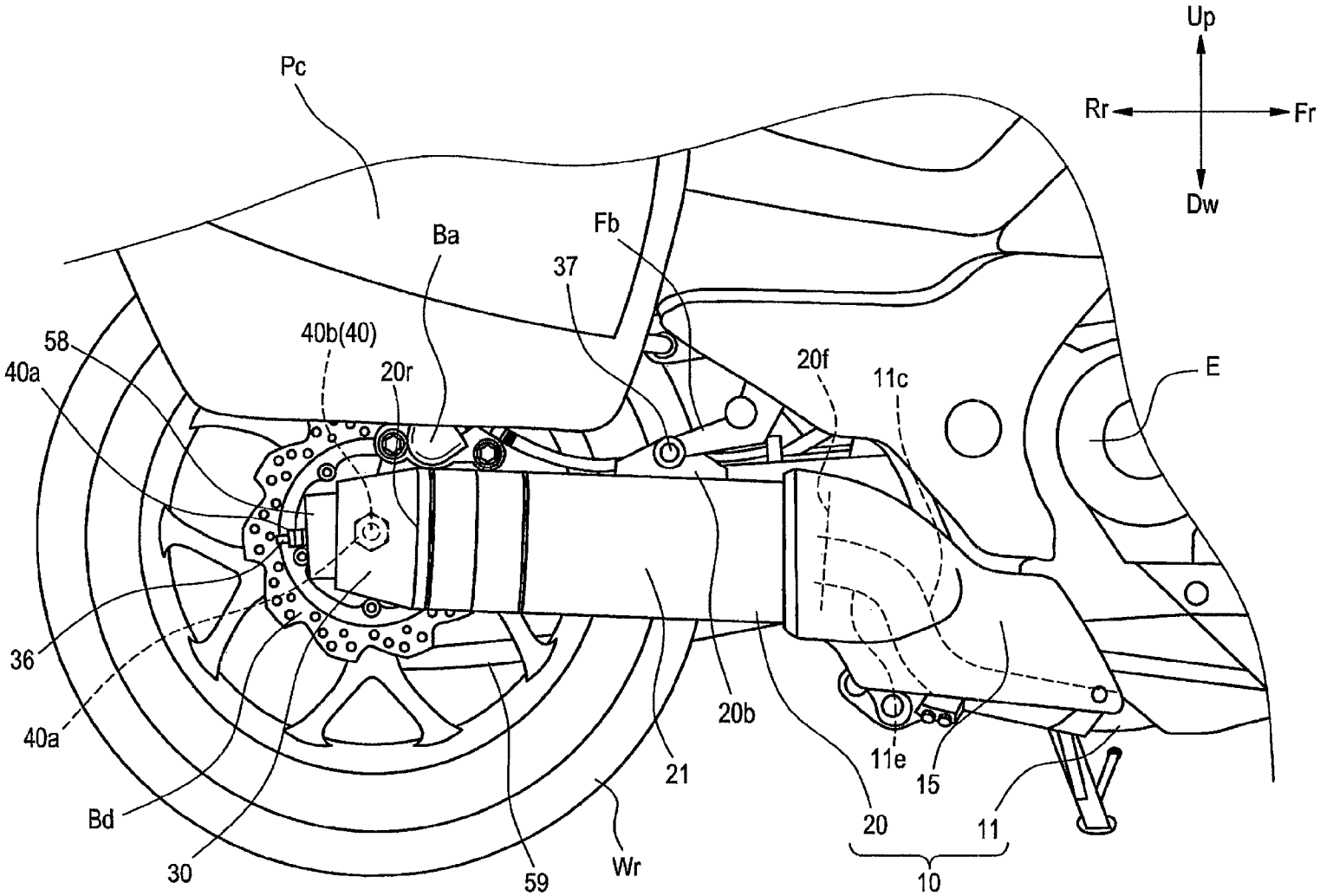
FIG. 3 is an enlarged side view of a main portion of the exhaust system in the saddle-ride type vehicle shown in FIG. 1.

As shown in FIG. 3, an end cap 30 is attached to a muffler rear end portion 20*r* of the muffler 20. Meanwhile, an exhaust pipe rear end portion 11*e* of the exhaust pipe 11 is connected to a muffler front end portion 20*f*. The muffler front end portion 20*f* is provided with a muffler cover 15 covering the rising portion 11*c* of the exhaust pipe 11 and its vicinity. The muffler 20 is provided with an attachment bracket 20*b* provided at an upper end of a cylindrical muffler body portion 21 and is fixed to an attachment frame Fb of the vehicle body frame F with a fastening bolt 37 and the like in such a way that the muffler body portion 21 is substantially horizontal.

As described above, in the embodiment, the end cap 30 is provided to be detachable and attachable to the muffler rear end portion 20*r* of the muffler 20. Moreover, in the muffler 20, the end cap 30 is located on the vehicle right outer side of an axle 40 of the rear wheel Wr. Since the axle 40 is located on the inner side of the end cap 30 of the muffler 20, the axle 40 is not visible in a side view of the vehicle. Thus, the appearance of the vehicle is excellent. Moreover, since the end cap 30 located on the outer side of the axle 40 is detachable and attachable, a work space for maintenance such as an axle position adjustment can be secured. Thus, the workability is thus excellent.

Figure 4:
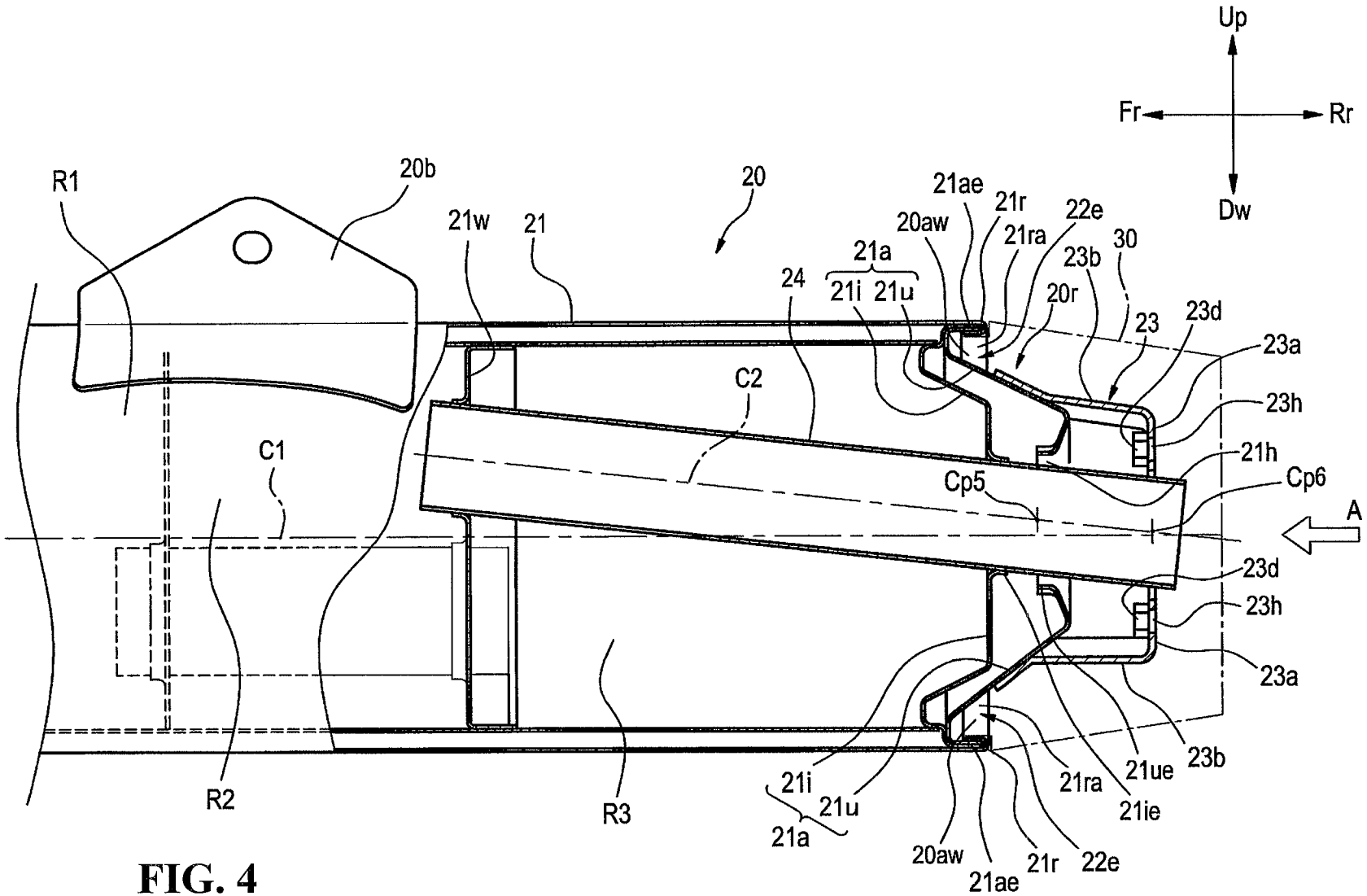
FIG. 4 is a schematic side view of a muffler in the exhaust system of the present invention, the muffler being partially cut away.

Further descriptions are given of the muffler 20 of the embodiment. For example, as shown in FIG. 4, the interior of the muffler body portion 21 is partitioned into multiple expansion chambers R1, R2, and R3 and a silencer portion and a catalyst are provided as needed. Exhaust gas exhausted from the exhaust pipe 11 into the muffler 20 expands in the expansion chambers R1, R2, and R3 and is then exhausted to the outside atmosphere from a tail pipe 24. A front end portion of the tail pipe 24 is held by a partitioning wall 21*w* while a rear end portion thereof is held by a closing wall 21*a* of the muffler rear end portion 20*r*. Moreover, the tail pipe 24 is provided in such a way that a tail pipe center axis C2 thereof is appropriately inclined with respect to a muffler center axis C1 of the muffler body portion 21.

In the embodiment, the closing wall 21*a* in a rear end portion of the muffler rear end portion 20*r* has, for example, a double-wall structure of an inner wall portion 21*i* and an outer wall portion 21*u*. The tail pipe 24 is fixed to an inner peripheral edge 21*ie* of the inner wall portion 21*i* but does not come into contact with an inner peripheral edge 21*ue* of the outer wall portion 21*u* disposed behind the inner wall portion 21*i* at an interval. More specifically, the tail pipe 24 extends rearwardly in such a way that the tail pipe center axis C2 of the tail pipe 24 passes an insertion port center point Cp5 of a circular tail pipe insertion port 21*h* formed by the inner peripheral edge 21*ue* of the outer wall portion 21*u*, with a small gap provided between the tail pipe 24 and the tail pipe insertion port 21*h*. The outer wall portion 21*u* is formed to have a tapered surface whose diameter becomes gradually smaller toward the rear of the vehicle with an end cap stay 23 for fixing the end cap 30 being attached to the outer wall portion 21*u*.

The structure of the muffler rear end portion 20*r* for attaching the end cap 30 in the embodiment includes, in addition to the end cap stay 23, an end cap inserted portion 22*e* to which the end cap 30 is inserted. More specifically, an outer peripheral portion 21*ae* (see enlarged views of FIGS. 10 and 11) of the closing wall 21*a* is interposed and held between part of the closing wall 21 and a rear edge folded portion 21*ra* in which a muffler body portion rear end 21*r* is folded toward the inner side of the muffler body portion and then toward the front of the vehicle. The rear edge folded portion 21*ra* is formed as an inserted portion inner peripheral wall surface 20*aw* of the end cap inserted portion 22*e*.

Figure 5:
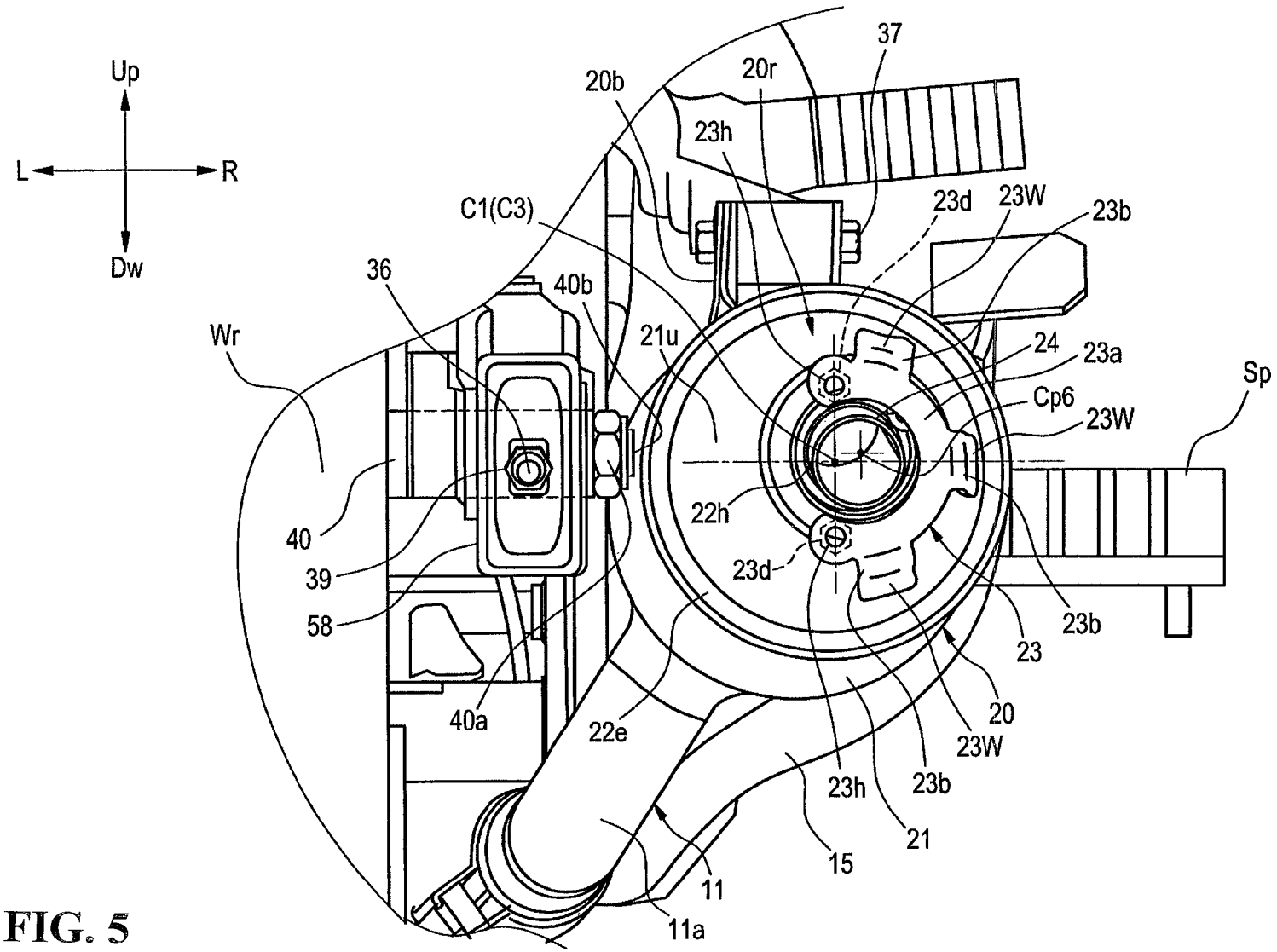
FIG. 5 is a partial enlarged back view of a muffler rear end portion as viewed from the back with an end cap of the muffler removed, in the saddle-ride type vehicle shown in FIG. 1.
Figure 6:
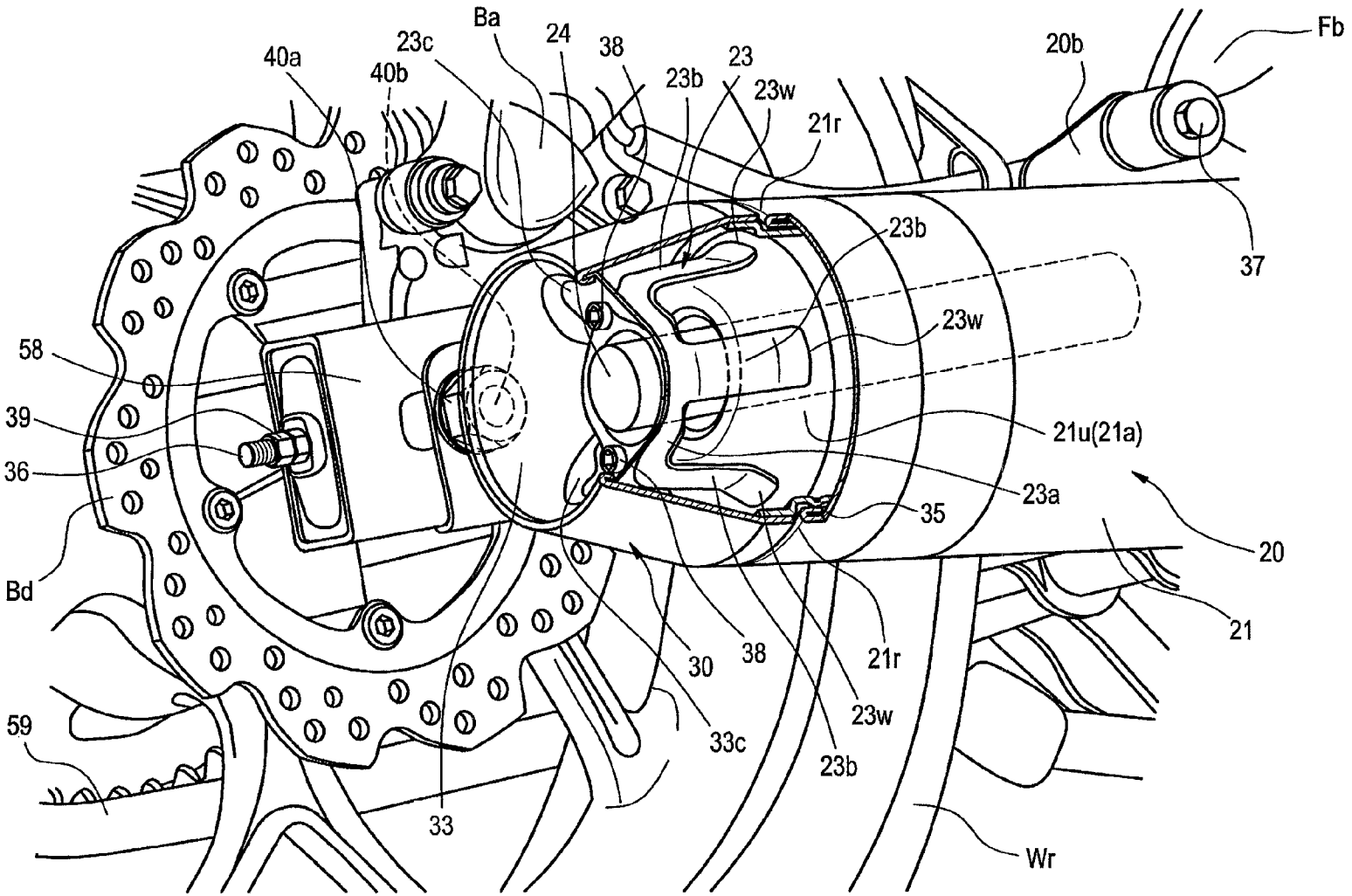
FIG. 6 is a partial enlarged perspective view of a muffler rear portion of the exhaust system shown in FIG. 3 as viewed in an oblique rearward direction, the muffler rear portion being partially cut away.

FIG. 5 shows a state where the end cap is removed while FIG. 6 shows a state where the end cap is attached.

As shown in FIGS. 5 and 6, the end cap stay 23 includes, for example, a cap attachment surface portion 23*a* having a substantial arc shape on a vehicle rear side and three leg portions 23*b* extending toward the front of the vehicle from the cap attachment surface portion 23*a*. A front end of each of the leg portions 23*b* is welded in, for example, a welded portion 23*w*. Moreover, the cap attachment surface portion 23*a* is provided with fastening screw insertion holes 23*h*, 23*h* in upper and lower end portions thereof. Boss portions 23*d*, 23*d* including female screws are provided on back sides of the fastening screw insertion holes 23*h*, 23*h* (a left side of the cap attachment surface portion 23*a* in FIG. 4).

In the maintenance work of an axle position adjustment, for example, the tension of a chain 59 for the rear drive wheel is adjusted by moving the axle 40 of the rear wheel Wr. In this maintenance work, first, for example, left and right axle fixing nuts 40*a*, 40*a* are unscrewed, the nuts 40*a*, 40*a* attached respectively to axle screw portions 40*b*, 40*b* protruding outwardly from the swingarms 58, 58 at left and right ends of the axle 40. Next, double nuts 39, 39 provided on screw shafts 36, 36 protruding from rear end portions of the swingarms 58, 58 are turned and adjusted to move the axle 40 in the front-rear direction and the tension of the chain 59 is thereby adjusted. Then, the double nuts 39, 39 are fastened and fixed and the nuts 40*a*, 40*a* are also fastened and fixed.

The boss portions 23*d* of the embodiment are disposed at two positions symmetric about the muffler center axis C1 (an end cap center axis C3 is coaxial thereto). Providing the boss portions 23*d* for fixing the end cap 30 respectively at two positions on an upper side and a lower side of a vertical direction of the vehicle which are symmetric about the muffler center axis C1 allows a space to be secured in a muffler left-right direction around the muffler rear end portion 20*r*, in a state where the end cap 30 is removed (state shown in FIG. 5). Accordingly, during maintenance work and the like, interference between the boss portions and tools for adjusting the axle position can be avoided.

Since the cap attachment surface portion 23*a* is opened on the axle 40 side in the end cap stay 23 of the embodiment, a space on the axle 40 side can be increased. Moreover, attaching the leg portions 23*b* at the positions offset from the muffler center axis C1 to the vehicle outer side (vehicle right outer side in FIG. 5) can also increase the space on the axle 40 side. As a result, when an axle adjusting tool for turning the axle fixing nut 40*a* provided at the front end of axle 40 and an axle adjusting tool for turning the double nuts 39 are used with the end cap 30 removed, interference between the tools and the end cap stay 23 can be avoided.

In the embodiment, the tail pipe 24 extends obliquely downwardly while being offset from the muffler center axis C1. More specifically, the tail pipe center axis C2 is arranged on the vehicle outer side (right side in FIG. 5) of the muffler center axis C1 to pass through an insertion port center point Cp5 (see FIG. 4) of the tail pipe insertion port 21*h* offset from the muffler center axis C1 to the upper side and the outer side and a cap attachment surface portion center point Cp6 of the cap attachment surface portion 23*a* and a pipe hole center point Cp4 of a tail pipe hole 33*h* of the end cap 30 that are arranged slightly below the insertion port center point Cp5. The cap attachment surface portion center point Cp6 is the center point of a substantially circular space inside the cap attachment surface portion 23*a*.

Since the tail pipe center axis C2 is offset from the muffler center axis C1 to the vehicle outer side, a rear end portion of the tail pipe 24 is located on the vehicle outer side when the end cap 30 is removed. Accordingly, in the maintenance work and the like, an interface between the tail pipe 24 and the tools necessary for an axle position adjustment can be avoided.

Moreover, since the cap attachment surface portion center point Cp6 is arranged to be offset from the muffler center axis C1 to the vehicle outer side, a larger space on the axle side of the muffler rear end portion 20*r* can be secured when the end cap 30 is removed. This structure can further effectively avoid the interference between the end cap stay 23 and the tools for axle position adjustment.

Furthermore, in the embodiment, since structural objects, such as end cap stays 23, which protrude from the muffler rear end portion 20*r* when the end cap 30 is removed are offset from the muffler center axis C1 to the vehicle outer side, the muffler center axis C1 can be arranged closer to the vehicle center. This can contribute to securing of a sufficient bank angle of the vehicle.

In addition, in the embodiment, the leg portions 23*b* for fixing the end cap stay 23 is welded to the outer wall portion 21*u* of the closing wall 21*a* as described above. Since the end cap stay 23 is welded to the outer wall portion 21*u*, fastening members such as fastening bolts are unnecessary and the number of parts can be reduced. Thus, the attachment structure can be made clean and simple.

The attachment structure of the end cap 30 of the embodiment is described in detail with reference to FIGS. 7 to 11.

Figure 7:
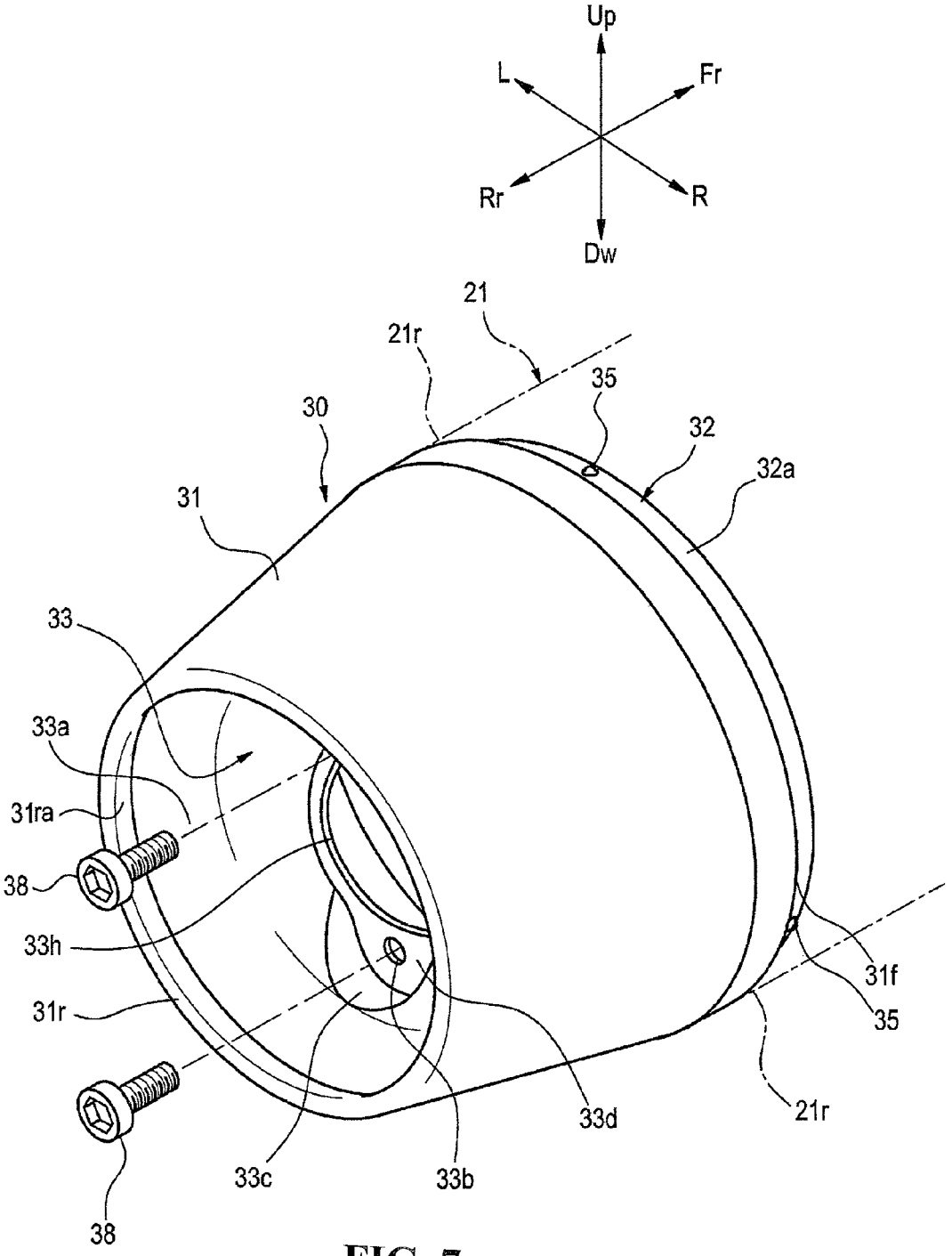
FIG. 7 is an enlarged perspective view of the end cap of the muffler in the saddle-ride type vehicle shown in FIG. 1.
Figure 8:
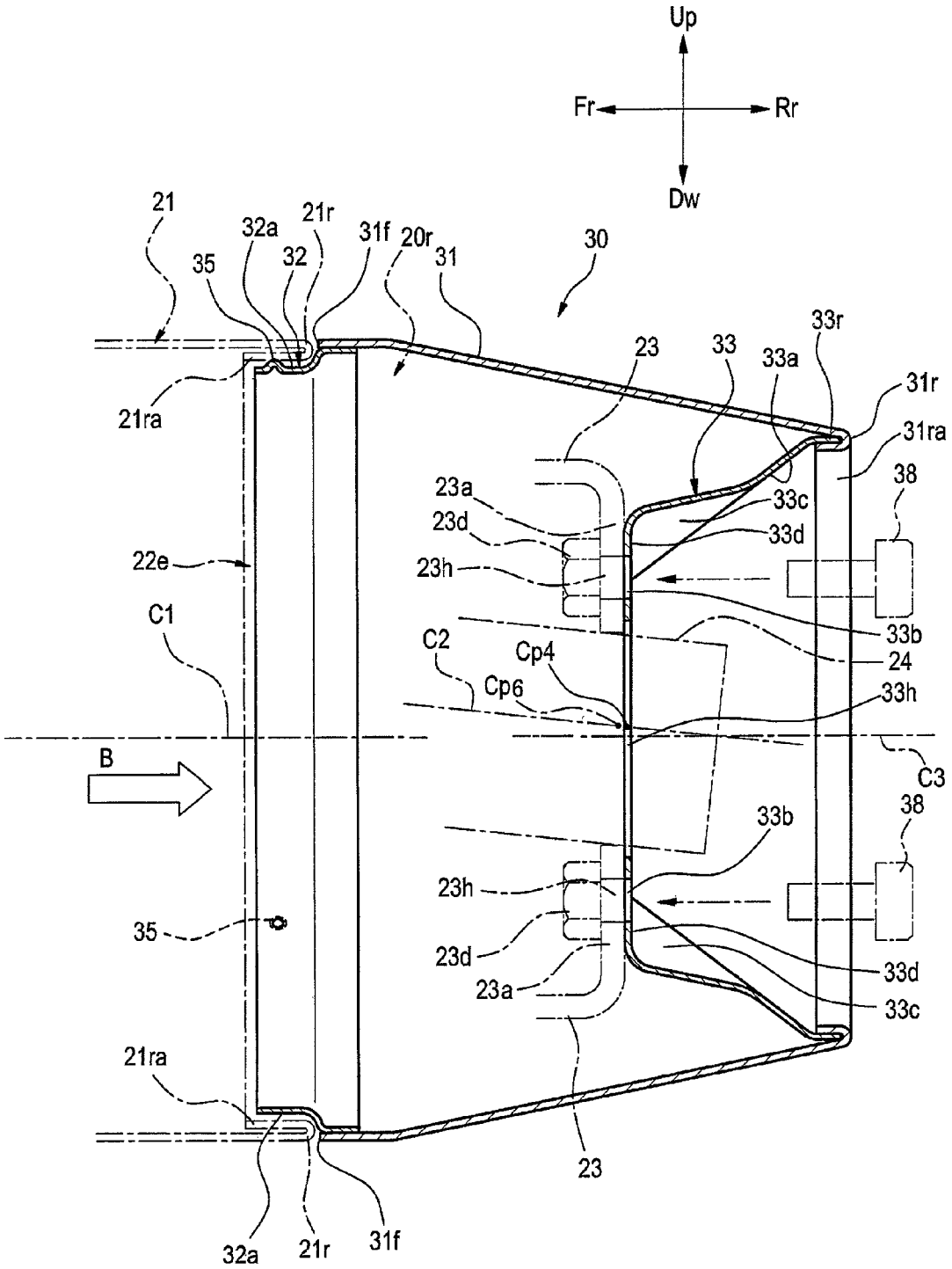
FIG. 8 is an enlarged cross-sectional view of the end cap shown in FIG. 7.

As shown in the perspective view of FIG. 7 and the cross-sectional view of FIG. 8, the end cap 30 includes a cap outer tube portion 31 having a tubular shape whose diameter becomes smaller toward the rear of the vehicle. Moreover, the end cap 30 is provided with a cap inner tube portion 33 attached to a rear end 31*r* inside the cap outer tube portion 31 and an insertion portion 32 extending forward from a front end 31*f* of the cap outer tube portion 31 and formed to have a diameter slightly smaller than the front end 31*f*.

Figure 9:
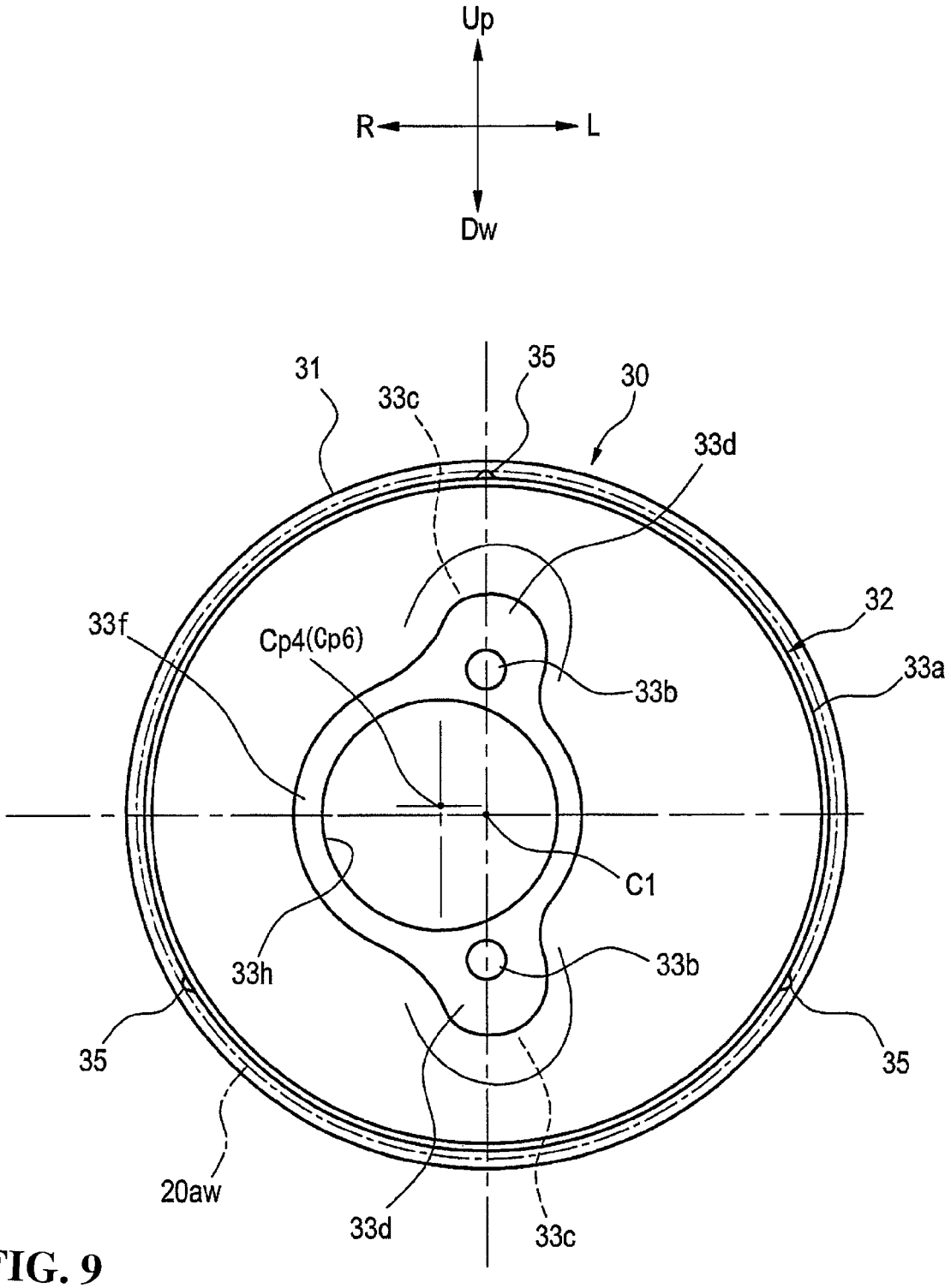
FIG. 9 is a front view of the end cap as viewed in the direction of the arrow B in FIG. 8.

As shown in FIGS. 8 and 9, multiple protruding portions 35 protruding outwardly in a cap radial direction are formed on an outer surface 32*a* of the insertion portion 32 in the end cap 30 of the embodiment. Three protruding portions 35 are arranged in the circumferential direction of the outer surface 32*a* at such positions that intervals therebetween are equal (positions at intervals of 120° as viewed in the direction of the end cap center axis C3 (coaxial to the muffler center axis C1) in the embodiment). Moreover, the protruding portions 35 protrude to come in contact with the inserted portion inner peripheral wall surface 20*aw* of the end cap inserted portion 22*e*.

As shown in FIGS. 7 and 8, the cap inner tube portion 33 of the end cap 30 is held in such a way that a rear end outer peripheral edge 33*r* thereof is interposed and held between part of the cap outer tube portion 31 and a folded portion 31*ra* of the rear end 31*r*, and includes a side wall portion 33*a* whose diameter becomes smaller from the rear end outer peripheral edge 33*r* toward the front of the vehicle. Moreover, the cap inner tube portion 33 includes a tail pipe hole 33*h* through which the tail pipe 24 is inserted, at a position slightly offset from a center portion (position on the right side and the upper side as viewed from the rear of the vehicle). Furthermore, a flat corresponding surface portion 33*f* overlappingly corresponding to the cap attachment surface portion 23*a* of the end cap stay 23 is provided in an outer peripheral portion of the tail pipe hole 33*h*, and flat fixed portions 33*d*, 33*d* larger than the corresponding surface portion 33*f* are formed on the upper and lower sides of the corresponding surface portion 33*f*. Paired upper and lower attachment holes 33*b*, 33*b* are formed respectively in the fixed portions 33*d*, 33*d*. The attachment holes 33*b*, 33*b* correspond respectively to the fastening screw insertion holes 23*h*, 23*h* of the cap attachment surface portion 23*a* and have such structures that fastening members 38, 38 are allowed to be screwed into the boss portions 23*d*, 23*d*.

In the embodiment, portions where the attachment holes 33*b*, 33*b* are formed are at positions relatively deep inside the end cap 30. However, tool insertion recessed portions 33*c* in which portions around the fixed portions 33*d*, 33*d* are recessed are formed in the side wall portion 33*a* to facilitate the insertion of a tool for fastening the fastening members 38, 38.

In the embodiment, the end cap center axis C3 that is the center of the end cap 30 is arranged coaxially with the muffler center axis C1 of the muffler 20. Meanwhile, as described above, the tail pipe center axis C2 is offset from the muffler center axis C1 to the right side and slightly to the upper side as viewed from the rear of the vehicle and is arranged to pass through the pipe hole center point Cp4 of the tail pipe hole 33*h*. Here, the pipe hole center point Cp4 of the tail pipe hole 33*h* and the cap attachment surface portion center point Cp6 of the cap attachment surface portion 23*a* are at positions substantially overlapping each other (see FIG. 9), although slightly offset in the vehicle front-rear direction (see FIG. 8).

Since the structure is such that the end cap center axis C3 and the muffler center axis C1 coincide (see FIG. 8) with each other as described above, the end cap 30 looks as if it is integrally connected to the muffler body portion 21 and is excellent in appearance. Moreover, the tail pipe 24 can be located on a vehicle body outer side and a work space for the axle adjustment can be thereby secured.

Attachment and assembly of the end cap 30 are described below with reference to FIGS. 10 and 11.

First, the insertion portion 32 of the end cap 30 is inserted into the end cap inserted portion 22*e* (direction of the arrow A). At this time, the front end of the insertion portion 32 enters the inner side of the inserted portion inner peripheral wall surface 20*aw*, and then, the three protruding portions 35 come into contact with a curved surface of an insertion guide inclined surface 21*rt* (a state shown by an one-dot chain line in FIG. 10). This is because the protruding height of each protruding portion 35 is set such that the protruding portion 35 is located on an outer side of the inner diameter of the inserted portion inner peripheral wall surface 20*aw*. By further pressing the end cap 30 inward, the protruding portions 35 are guided to the inner side of the inserted portion inner peripheral wall surface 20*aw* by the insertion guide inclined surface 21*rt* (a state shown in FIG. 10).

Figure 10:
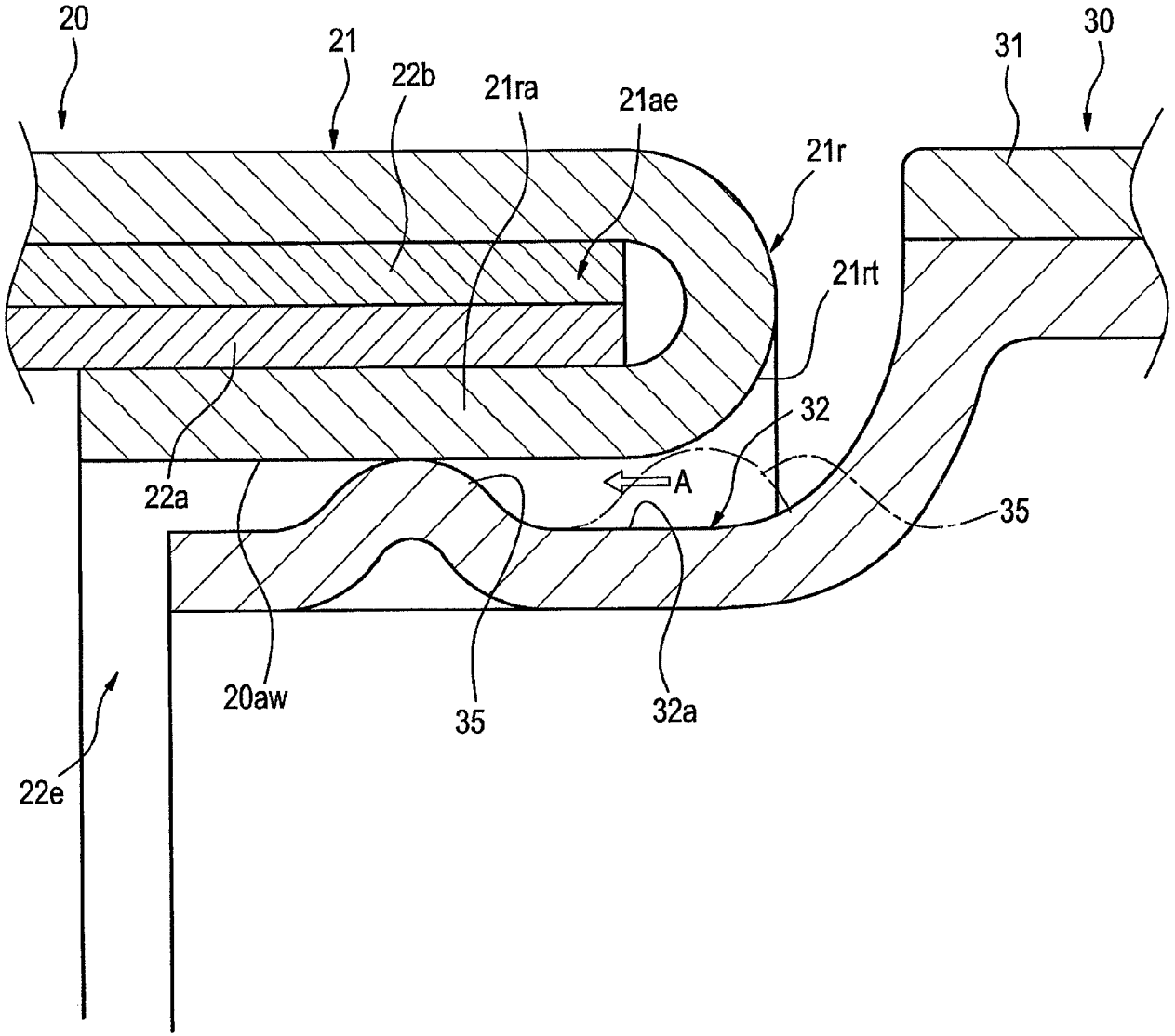
FIG. 10 is an enlarged cross-sectional view showing an engagement state between an end cap inserted portion of the muffler rear end portion and protruding portions of an insertion portion of the end cap.
Figure 11:
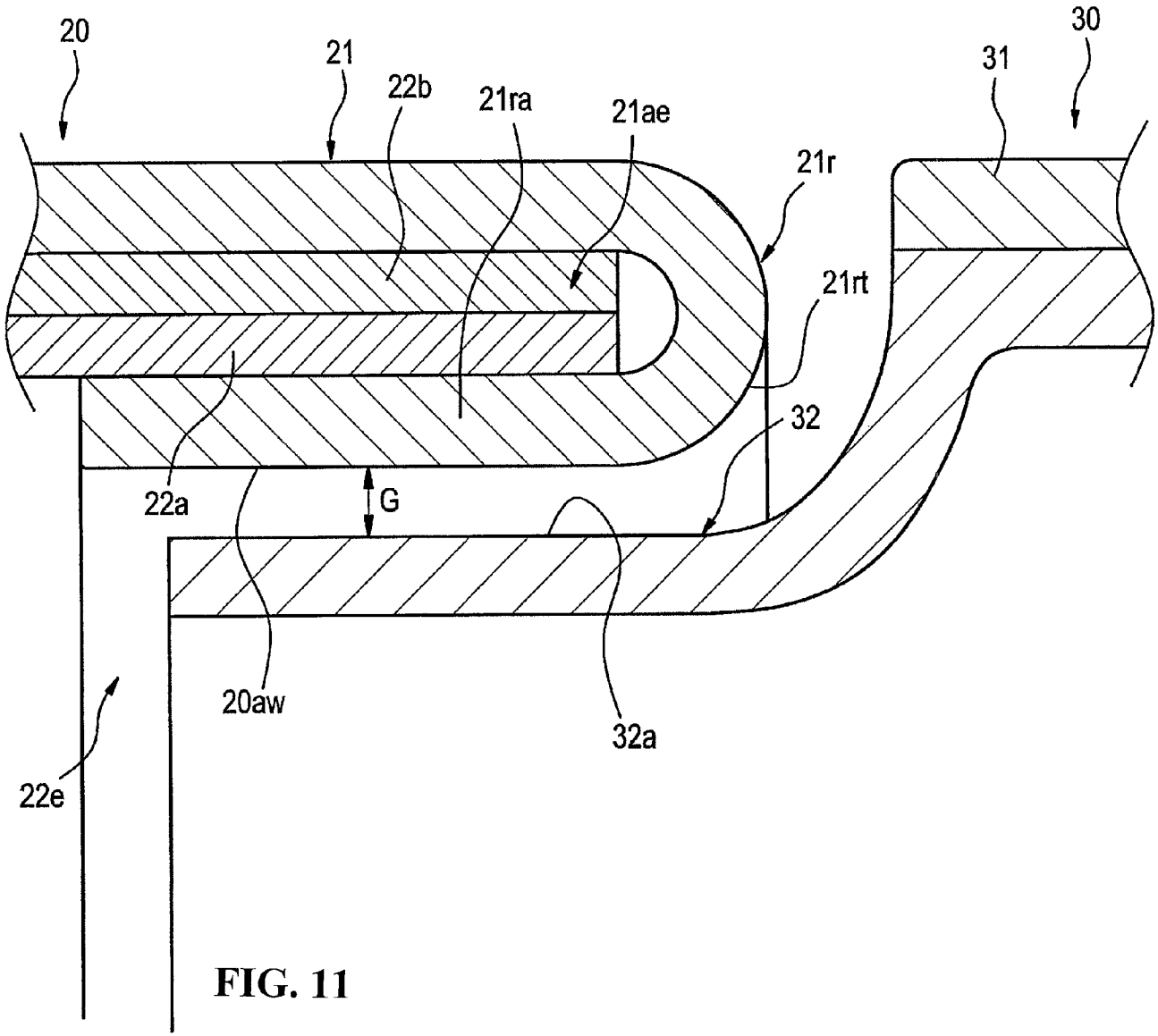
FIG. 11 is an enlarged cross-sectional view showing an engagement state between the end cap inserted portion of the muffler rear end portion and portions other than the protruding portions of the insertion portion of the end cap.

The insertion operation of the insertion portion 32 of the end cap 30 causes the end cap 30 to be set to a state where the three protruding portions 35 are brought in contact with the inserted portion inner peripheral wall surface 20*aw* as shown in FIG. 10. Meanwhile, in portions other than the protruding portions 35, as shown in FIG. 11, a gap G is formed between the inserted portion inner peripheral wall surface 20*aw* and the outer surface 32*a*. In a state where the three protruding portions 35 are in contact with the inserted portion inner peripheral wall surface 20*aw*, there is achieved alignment in which the end cap center axis C3 is aligned with the muffler center axis C1. In the state where the alignment is achieved, the attachment holes 33*b*, 33*b* can be easily aligned with the fastening screw insertion holes 23*h*, 23*h* by turning the end cap 30. Thereafter, the fastening members 38, 38 are screwed into the boss portions 23*d*, 23*d* and the end cap 30 is thereby fixed.

The embodiment to which the present invention is applied has been described above. However, the present invention is not limited to this. For example, although the cap attachment surface portion 23*a* is formed in the arc shape in the embodiment described above, the shape is not limited to the arc shape. Moreover, in the structure described above, the number of the leg portions 23*a* is three but may be any number other than three.

Furthermore, in the embodiment described above, the description is given of the motorcycle. However, the present invention is not limited to this and can be applied to other saddle-ride type vehicles such as three-wheel vehicles and four-wheel vehicles.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An exhaust system of a saddle-ride vehicle includes a tubular muffler connected to an exhaust pipe for discharging exhaust of an engine, the muffler is disposed laterally to a rear wheel rotatably supported by a swingarm via an axle, comprising:

an end cap configured to cover a muffler rear end portion of the muffler, said end cap being detachably and attachably provided on the muffler rear end portion; and said end cap is disposed on a vehicle outer side of the axle at such a position that the axle is invisible in a side view of the vehicle, wherein an end cap stay configured to fix the end cap is provided in the muffler rear end portion;

the end cap stay includes a cap attachment surface portion formed to have an arc shape surrounding a muffler center axis of the muffler and a substantially inverted C-shape opened on the axle side in a rear view of the vehicle and a plurality of leg portions extending from the cap attachment surface portion toward a closing wall of the muffler rear end portion; and the leg portions are disposed on the vehicle outer side of the muffler center axis.

2. The exhaust system of a saddle-ride vehicle according to claim 1, wherein:

the end cap is attached to a boss portion provided in the muffler rear end portion with a fastening member; and the boss portion is provided at two positions on an upper side and a lower side of a vertical direction of the vehicle which are symmetric to each other about a muffler center axis.

3. The exhaust system of a saddle-ride vehicle according to claim 1, wherein the cap attachment surface portion is disposed in such a way that a cap attachment surface portion center point of a space into which a tail pipe for discharging the exhaust from the muffler is inserted is offset from the muffler center axis to the vehicle outer side.

4. The exhaust system of a saddle-ride vehicle according to claim 1, wherein the leg portions of the end cap stay are welded to the closing wall.

5. The exhaust system of a saddle-ride vehicle according to claim 2, wherein the leg portions of the end cap stay are welded to the closing wall.

6. The exhaust system of a saddle-ride vehicle according to claim 1, wherein:

a tail pipe center axis of the tail pipe is offset from the muffler center axis to the vehicle outer side; and the cap attachment surface portion center point is arranged on the tail pipe center axis.

7. The exhaust system of a saddle-ride vehicle according to claim 3, wherein:

a tail pipe center axis of the tail pipe is offset from the muffler center axis to the vehicle outer side; and the cap attachment surface portion center point is arranged on the tail pipe center axis.

8. The exhaust system of a saddle-ride vehicle according to claim 4, wherein:

a tail pipe center axis of the tail pipe is offset from the muffler center axis to the vehicle outer side; and the cap attachment surface portion center point is arranged on the tail pipe center axis.

9. The exhaust system of a saddle-ride vehicle according to claim 1, wherein an insertion portion provided at a front end of the end cap is inserted to come into contact with an end cap inserted portion of the muffler rear end portion.

10. The exhaust system of a saddle-ride vehicle according to claim 2, wherein an insertion portion provided at a front end of the end cap is inserted to come into contact with an end cap inserted portion of the muffler rear end portion.

11. The exhaust system of a saddle-ride vehicle according to claim 5, wherein an insertion portion provided at a front end of the end cap is inserted to come into contact with an end cap inserted portion of the muffler rear end portion.

12. The exhaust system of a saddle-ride vehicle according to claim 6, wherein:

an end cap center axis of the end cap and the muffler center axis of the muffler are coaxially arranged; and a tail pipe hole of the end cap through which the tail pipe is inserted is offset from the end cap center axis.

13. The exhaust system of a saddle-ride vehicle according to claim 9, wherein:

an end cap center axis of the end cap and the muffler center axis of the muffler are coaxially arranged; and a tail pipe hole of the end cap through which the tail pipe is inserted is offset from the end cap center axis.

14. An exhaust system of a saddle-ride vehicle comprising:

a muffler operatively connected to an exhaust pipe, said muffler including a rear end portion;

said muffler being disposed laterally to a rear wheel of the vehicle;

an end cap configured to cover the muffler rear end portion, said end cap being detachably and attachably mounted on the muffler rear end portion; and said end cap is disposed on a vehicle outer side of an axle at such a position that the axle is invisible in a side view of the vehicle, wherein an end cap stay configured to fix the end cap is provided in the muffler rear end portion;

the end cap stay includes a cap attachment surface portion formed to have an arc shape surrounding a muffler center axis of the muffler and a substantially inverted C-shape opened on the axle side in a rear view of the vehicle and a plurality of leg portions extending from the cap attachment surface portion toward a closing wall of the muffler rear end portion; and the leg portions are disposed on the vehicle outer side of the muffler center axis.

15. The exhaust system of a saddle-ride vehicle according to claim 14, wherein:

the end cap is attached to a boss portion provided in the muffler rear end portion with a fastening member; and the boss portion is provided at two positions on an upper side and a lower side of a vertical direction of the vehicle that are symmetric to each other about a muffler center axis.

16. The exhaust system of a saddle-ride vehicle according to claim 14, wherein the cap attachment surface portion is disposed in such a way that a cap attachment surface portion center point of a space into which a tail pipe for discharging the exhaust from the muffler is inserted is offset from the muffler center axis to the vehicle outer side.

17. The exhaust system of a saddle-ride vehicle according to claim 14, wherein the leg portions of the end cap stay are welded to the closing wall.

* * * * *